United States Patent [19]

Savoy

[11] 4,043,480

[45] Aug. 23, 1977

[54] COVER WITH SPRING OPENED LID

[75] Inventor: Jerry Savoy, Lynnfield, Mass.

[73] Assignee: Savoy Manufacturing Corporation, Haverhill, Mass.

[21] Appl. No.: 684,903

[22] Filed: May 10, 1976

[51] Int. Cl.[2] ..... B65D 43/16

[52] U.S. Cl. ..... 220/334

[58] Field of Search ..... 220/260, 264, 334, 335; 150/46

[56] References Cited

U.S. PATENT DOCUMENTS

| | | | |
|---|---|---|---|
| 2,483,304 | 9/1949 | Vogel | 150/46 UX |
| 2,490,746 | 12/1949 | Carpenter | 220/334 |
| 2,581,615 | 1/1952 | Whitelaw | 220/334 |

FOREIGN PATENT DOCUMENTS

| | | | |
|---|---|---|---|
| 186,543 | 10/1922 | United Kingdom | 220/334 |

*Primary Examiner*—Donald F. Norton

*Attorney, Agent, or Firm*—Pearson & Pearson

[57] ABSTRACT

An attache case, or cassette-carrying case of rectangular, cubical configuration has a tray-like bottom and an inverted tray-like lid, hingedly connected thereto along one pair of juxtaposed rims, and has latching, or locking, mechanism along the opposite pair of juxtaposed rims. A leaf spring of thin material, bent into an S shape, is hidden behind the lining of the case, with a lower portion permanently, or detachably, affixed, below the hinge, to the rear wall of the bottom and the upper portion extending above the hinge and along the rear wall of the lid to spring the lid open upon release of the latch.

4 Claims, 5 Drawing Figures

COVER WITH SPRING OPENED LID

BACKGROUND OF THE INVENTION

It has heretofore been proposed to provide covers of small receptacles which spring open when a latch is released as in U.S. Pat. No. 490,433 to Goertz of Jan. 24, 1893 wherein a coil spring around the hinge throws the cover of a bag open when a spring catch is released. Distorting the metal of a bag cover is disclosed in U.S. Pat. No. 1,505,393 to Kasdan of Aug. 19, 1924 for springing the cover open when a latch is released while the cover is urged to closed position by a coil spring hinge in U.S. Pat. No. 1,473,972 to Prahar of Nov. 13, 1923.

The coil spring hinges of the relatively small receptacles and covers of the above mentioned patents, and larger size coil spring hinges of various types commercially available have not been found suitable for spring opening the lid of attache cases, cassette cases and luggage because the spring becomes so large as to be awkward in appearance and to make the hinge portion unduly prominent and visible.

SUMMARY OF THE INVENTION

In this invention, the cassette case remains unchanged in appearance both inside and outside, and the relatively large and heavy lid is resiliently urged to open position when the latch is released by a single leaf spring, preferably hidden behind the lining of the case and preferably arranged to be slidably removed if not desired by the customer or in case replacement becomes necessary.

The leaf spring is centered against the rear wall of the bottom end of the lid and is so thin, that its normal S shape enables it to be in intimate engagement against the wall surface so as not to cause a visible protrusion in the lining. The lower portion of the spring is either affixed to the rear wall of the bottom by screws, or may slide down behind a strip screwed to the rear wall while the upper portion engages the inside of the lid, under the lining, but is free to move and slide as the lid springs open.

Figures 1, 2, 3, 4, 5:
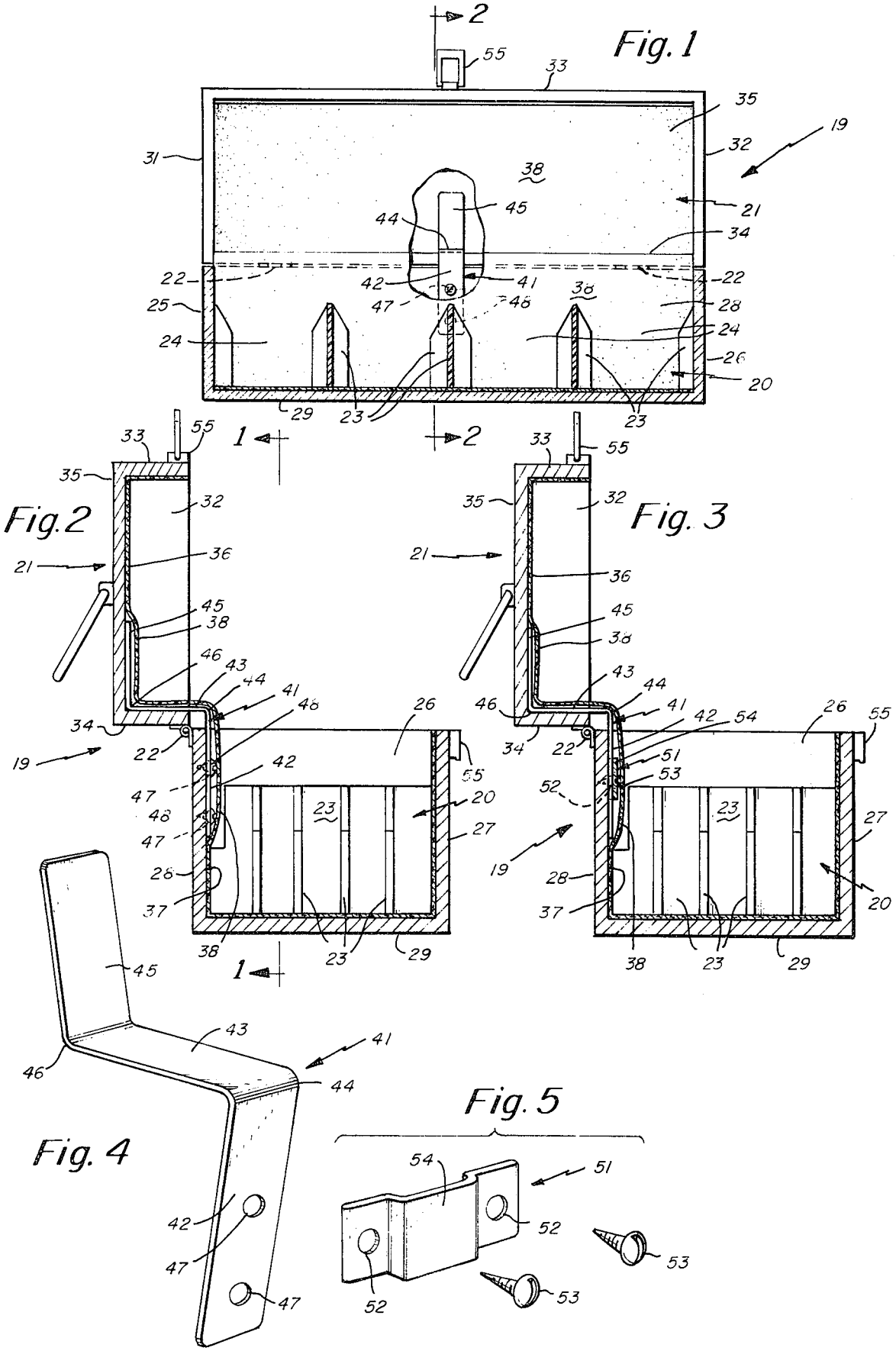
FIG. 1 is a front elevational view of a cassette case of the invention, in section on line 1—1 of FIG. 2.
FIG. 2 is an end elevational view of the case shown in FIG. 1 in section on line 2—2 of FIG. 1.
FIG. 3 is a view similar to FIG. 2, showing the leaf spring slidably removable.
FIG. 4 is an enlarged perspective view of the S shaped spring of the invention.
FIG. 5 is a view similar to FIG. 4 showing the cross strip.

In the drawing the cassette case, or attache case 19 is of generally rectangular, or cubical configuration with a tray-like bottom 20 and an inverted tray-like lid 21. The bottom 20 may include partitions 23 for forming a plurality of cassette compartments 24 and it will be seen that the case is relatively large as compared to a ladies handbag, music box, watch case or the like so that a relatively powerful spring is required to lift the lid against gravitational forces.

The bottom 20 also includes opposite end walls 25 and 26, a front wall 27, rear wall 28 and bottom wall 29.

The lid 21 includes opposite end walls 31 and 32, a front wall 33, rear wall 34 and top wall 35. The inside face of the lid 21 is indicated at 36 and the lining which covers the inside face 36 as well as the inside face 37 of the bottom 20 is indicated at 38, the lining being flexible, soft fabric such as velvet, plastic or suitable material usually adhered by an adhesive in a spot pattern, but sufficiently loose to permit covering the hinges 22 as the lid is opened and closed, as shown.

A leaf spring 41, of spring metal or other suitable material, and of the normal S shape shown in FIG. 4, includes the lower portion 42, an intermediate portion 43 bent angularly therefrom at 44, and an upper portion 45 bent angularly upward at 46 from the intermediate portion. One or more screw holes such as 47 are provided in lower portion 42 for attachment by screws 48 to the rear wall 28 of bottom 20 as shown in FIG. 1 and 2.

Preferably, however, a cross strip 51 is provided, which includes screw holes 52 for screws 53 for affixation to rear wall 28 of bottom 20, there being an integral groove 54 centrally of the strip 51 to slidably receive the low portion 42 of the S shaped leaf spring 41. Thus the spring may be permanently affixed by screws 48 in holes 47 or may be slidably detachable for replacement by means of the cross strip 51.

It will be seen that as the lid, or cover, 21 is closed the latch means 55, mounted on the front wall 33 of the lid and the front wall 27 of the bottom will lock and the spring upper portion 45 will slide behind the lining and along the face 36 of the lid while distorting slightly in shape under compression but without damaging or unduly displacing the adhered lining. Upon release of the latch means, which may be any conventional luggage catch, latch or lock, the lid will automatically spring to the open position of FIGS. 1–3 to occupy its hidden position closely against the lid wall and behind the now relatively flat lining. Needless to say any distortion of the spring and lining is not visible to the user because it occurs only when the case is closed, or as it is being closed.

I claim:

1. In combination:

a case of generally cubical configuration having a tray-like bottom with a top lid hingedly connected thereto;

realeasable latch means on said bottom and lid, normally holding said lid in closed position on said bottom;

said tray-like bottom and top lid each having inside walls covered with a flexible fabric lining;

and a leaf spring, normally of S shape and independent of said hinge connection, said spring having a lower portion affixed to the inner wall of said bottom below, and an upper portion engaging the inner wall of said lid above, said hinge connection, for automatically and resiliently raising said lid when said latch means is released.

said leaf spring being underneath said lining and not visible.

2. A combination as specified in claim 1 wherein:

said leaf spring is normally of bent configuration comprising when not under compression, said lower portion, an intermediate integral portion bent rearwardly at an angle thereto and said upper portion bent upwardly and integrally at an angle to said intermediate portion.

3. A combination as specified in claim 1 wherein:

said case includes a horizontal strip affixed to the inside wall of said bottom below said hinge, said strip being spaced from said wall in the central portion thereof and said lower portion of said leaf spring is slidably engaged behind the central portion of said strip, for ready slidable removal of said leaf spring if the lid is not desired to be spring biased to open position.

4. A case for carrying a plurality of cassettes, said case having a deep tray-like bottom with a front wall and a rear wall and a shallow tray-like lid with a lid front wall and a lid rear wall:

hinge means connecting the rear wall of said bottom with the rear wall of said lid;

latch means, on the front wall of said bottom and the front wall of said lid for releasably holding said lid in closed position on said bottom and a leaf spring, normally bent into generally S shaped configuration, said spring having a lower portion attached to the inside of the rear wall of said bottom and an upper portion in engagement with the inside of the rear wall of said lid, said spring being in compression when said lid is closed but resiliently and automatically springing said lid into open position when said latch means is released.

* * * * *